US006428653B1

(12) United States Patent
Denton et al.

(10) Patent No.: US 6,428,653 B1
(45) Date of Patent: Aug. 6, 2002

(54) METHOD OF BLEACHING WITH FORMAMIDINE SULFINIC ACID USING A REDUCING AGENT TO ELIMINATE RESIDUAL PEROXIDE

(75) Inventors: Richard C. Denton, Slave Lake (CA); Gorgen Akerlund, Sollentuna (SE)

(73) Assignee: West Fraser Timber Co. Ltd., Slave Lake (CA)

( * ) Notice: Subject to any disclaimer, the term of this patent is extended or adjusted under 35 U.S.C. 154(b) by 0 days.

(21) Appl. No.: 09/728,979

(22) Filed: Dec. 4, 2000

(51) Int. Cl.[7] ..... D21C 9/16

(52) U.S. Cl. ..... 162/24; 162/71; 162/76; 162/78; 162/80; 162/83

(58) Field of Search ..... 162/78, 76, 72, 162/80, 83, 24, 60, 71

(56) References Cited

U.S. PATENT DOCUMENTS

| | | | |
|---|---|---|---|
| 3,100,732 | A | 8/1963 | Smedberg |
| 3,384,534 | A | 5/1968 | Kindron et al. |
| 3,481,828 | A | 12/1969 | Turner et al. |
| 3,507,743 | A | 4/1970 | Cartsunis et al. |
| 3,709,778 | A | 1/1973 | Lincoln et al. |
| 4,244,780 | A | 1/1981 | Rende et al. |
| 4,675,076 | A | 6/1987 | Darlington |
| 4,804,440 | A | 2/1989 | Liebergott et al. |
| 5,073,301 | A | 12/1991 | Suess et al. |
| 5,534,115 | A | 7/1996 | Hoyos et al. |
| 5,958,184 | A | 9/1999 | Kanada et al. |

FOREIGN PATENT DOCUMENTS

| | | | | |
|---|---|---|---|---|
| CA | 916367 | | 12/1972 | |
| EP | 0 187 477 | * | 7/1986 | ..... 162/78 |

* cited by examiner

*Primary Examiner*—Steve Alvo
(74) *Attorney, Agent, or Firm*—Terrence N. Kuharchuk; Rodman & Rodman

(57) ABSTRACT

A process for final bleaching cellulose-containing pulp which has been subjected to previous bleaching with a peroxide compound. The process involves the sequential steps of exposing the pulp to an amount of a reducing agent in order to eliminate residual peroxide compound from the pulp and then final bleaching the pulp by exposing the pulp to an amount of formamidine sulfinic acid.

18 Claims, No Drawings

METHOD OF BLEACHING WITH FORMAMIDINE SULFINIC ACID USING A REDUCING AGENT TO ELIMINATE RESIDUAL PEROXIDE

TECHNICAL FIELD

A process for bleaching cellulose-containing pulp which has been subjected to previous bleaching with an oxidizing agent such as a peroxide compound.

BACKGROUND OF THE INVENTION

The bleaching of cellulose pulps has been conducted for many years. The purpose of bleaching pulp is to create a resultant pulp product which is suitable for use in producing a wide range of derivative products such as newsprint, printing papers, molded articles, corrugated paper, cardboard, paperboard etc.

As a general rule, the value of the resultant pulp product increases with the effectiveness of the bleaching process that the pulp is subjected to.

The term "cellulose-containing pulp" includes any pulp which comprises an amount of cellulose, which is the chief component of the cell walls of plants. Representative forms of cellulose-containing pulp include wood pulps, straw pulps, hemp pulps, cotton pulps, etc. The pulp most commonly used in the manufacture of paper products is wood pulp.

Wood pulps are classified according to the manner in which they are created. Mechanical wood pulps are created solely by mechanical action which is imparted to wood particles to reduce them to fibers. Chemical wood pulps are created solely by using chemical action to strip wood particles of their non-cellulosic materials such as lignins and impurities. Chemi-mechanical wood pulps are created by the use of chemical softeners to pre-treat wood particles, followed by mechanical action to reduce the softened wood particles to fibers.

Pulps produced by mechanical and chemi-mechanical pulping techniques are often referred to collectively as "mechanical pulps" to distinguish them from "chemical pulps" which are produced purely by chemical pulping techniques.

As a result of the mechanism of action of chemical pulping techniques, chemical pulps tend to contain high proportions of cellulose, typically in the order of about 80% to about 95% by weight of pulp. Chemical pulps are sometimes referred to as "high cellulose" or "low yield" pulps.

Mechanical pulps resulting from mechanical pulping techniques continue to contain significant amounts of non-cellulosic materials, with the result that mechanical pulps are referred to as "low cellulose" or "high yield" pulps. The cellulose content of mechanical pulps is typically in the order of about 40% to about 60% by weight of pulp.

Bleaching processes for cellulose-containing pulps such as wood pulps can be roughly divided into three categories. The first category is bleaching with oxidizing agents such as peroxide compounds. The second category is bleaching with oxidizing agents containing chlorine. The third category is bleaching with reducing agents.

Peroxide bleaching is commonly used for bleaching pulps derived from mechanical pulping techniques because of demonstrated effectiveness in bleaching pulps containing significant amounts of lignins and other impurities.

Chlorine bleaching is commonly used for bleaching pulps derived from chemical pulping techniques in which the lignin content is minimized.

Bleaching with reducing agents has been used for pulps derived from both mechanical pulping techniques and chemical pulping techniques.

Current and evolving technologies for bleaching both mechanical and chemical pulps often involve "multi-stage bleaching", in which combinations of bleaching processes are used in an effort to achieve a higher level of pulp brightness.

A second issue which is sometimes addressed by these technologies relates to minimizing the amount of colour reversion which is experienced by the pulp following the bleaching process. Colour reversion is a particular concern with mechanical pulps, which contain a relatively high amount of lignin and other impurities. It is believed that it is the lignin and these other impurities which may be largely responsible for colour reversion in mechanical pulps.

U.S. Pat. No. 3,100,732 (Smedberg) relates to a bleaching process involving the combined and simultaneous action of peroxide and borohydride. The stated purpose of the process is to eliminate the need to neutralize the pulp using sulfur dioxide after peroxide bleaching. Smedberg also discusses the trend toward multi-stage bleaching processes for both mechanical and chemical pulps. In particular, Smedberg describes a prior art two stage bleaching process for mechanical pulps in which the pulp is initially bleached with peroxide, is neutralized with sulfur dioxide to prevent colour reversion, and is then subjected to a second bleaching stage with a chelating agent and a reducing agent such as a hydrosulfite.

The issue of colour reversion relating to peroxide bleached pulps is addressed further in U.S. Pat. No. 3,709,778 (Lincoln et al) and Canadian Patent No. 916,367 (Meyers et al), in which mechanical pulps which have been bleached with a peroxide compound are thereafter contacted with a sulfite compound as an after-treatment to avoid colour reversion caused by active oxygen compounds remaining in the pulp. In other words, it is theorized in these references that it is residual peroxide and not lignin which is responsible for colour reversion in mechanical pulps.

The use of thiourea dioxide (also known as formamidine sulfinic acid or FAS) and related compounds in connection with the bleaching of both mechanical and chemical pulps is known.

U.S. Pat. No. 3,384,534 (Kindron et al) describes a single stage bleaching process for mechanical pulps using thiourea dioxide. U.S. Pat. No. 3,481,828 (Turner et al) describes a single stage bleaching process for mechanical pulps using a bleaching composition which contains both thiourea dioxide and zinc sulphate. U.S. Pat. No. 3,507,743 (Cartsunis et al) describes a single stage bleaching process for mechanical pulps in which thiourea is added to reductive bleaching agents such as alkali metal borohydride or thiourea dioxide in order to minimize the colour reversion of the bleached pulp.

U.S. Pat. No. 4,244,780 (Rende et al) describes the addition of thiourea dioxide during chlorine bleaching of chemical pulps for the purpose of creating bleached pulps having improved fiber strength. Although it is stated that the Rende invention may be used in conjunction with multi-stage bleaching processes, the thiourea dioxide must be present during the initial chlorination stage in order to be effective.

U.S. Pat. No. 5,073,301 (Suess et al) describes a process for stabilizing the viscosity of wood pulps which have been treated with ozone or ozone/oxygen (but not with chlorine). The process involves treating the pulp with formamidine sulfinic acid during an alkali extraction step which takes place after the ozone or ozone/oxygen treatment. The alkali extraction step occurs at a pH of between 8 and 12 and at a temperature of between 40° Celsius and 90° Celsius. Additional bleaching steps may be performed after the alkali extraction step.

The use of thiourea dioxide in multi-stage bleaching processes involving peroxide compounds is also known.

U.S. Pat. No. 4,675,076 (Darlington) describes a method for additional bleaching of mechanical pulps following peroxide bleaching, in which thiourea is added to the pulp at a pH of between 4 and 7 in the presence of residual peroxide. The pulp is then maintained at a pH of between 8 and 11 to achieve further bleaching of the pulp as the thiourea reacts with the residual peroxide to form thiourea dioxide. Optionally, the pH of the pulp may thereafter be lowered to between 5 and 6 to achieve further additional bleaching of the pulp. Finally, the pulp may optionally be subjected to a final peroxide bleaching step to gain yet additional pulp brightness.

Similarly, U.S. Pat. No. 5,958,184 (Kanada et al) describes an "on-site" process for economically producing thiourea dioxide for the purpose of pulp bleaching, which process involves the mixing of thiourea, a peroxide and optionally at least one reaction catalyst. The mixing step may occur either in the presence or in the absence of pulp. The process is expressed to be a substitute for post-bleaching of pulps with other reducing agents.

U.S. Pat. No. 4,804,440 (Liebergott et al) describes a multi-stage "super-brightening" bleaching process for mechanical pulps in which the pulp is treated sequentially with a peroxygen compound, a reducing compound, and a final peroxygen compound. The pulp may be washed or pressed between the first and second bleaching stages, but such washing or pressing is described as optional. If the pulp is washed between these stages, it is indicated that the washing may take place in the presence of sulfur dioxide or some other source of sulfite ions in order to bring the pH of the pulp into a range of between 5 and 6 for the subsequent bleaching stage using the reducing compound. Among the listed possible reducing compounds is thiourea dioxide.

U.S. Pat. No. 5,534,115 (Hoyos et al) describes a process for preserving the mechanical strength properties of chemical pulps in which a bleaching stage with a reducing compound is interposed between two bleaching stages with a peroxidic reagent. The first peroxidic bleaching stage takes place in an acidic environment (at a pH of less than 5) while the second peroxidic bleaching stage takes place in an alkaline environment (at a pH of above 9). The preferred reducing compound is formamidine sulfinic acid.

In practice, bleaching with oxidizing agents such as peroxide compounds is commonly employed in pulp mills, particularly as a first stage bleaching for mechanical pulps. As discussed in Smedberg, second stage bleaching with dithionite (sodium hydrosulfite) as a reducing agent is sometimes used in paper mills to increase the brightness of the pulp beyond that which is possible solely by using peroxide compounds. Alternatively, initial dithionite bleaching may be followed by one or more stages of peroxide bleaching.

Unfortunately, as discussed above some pulps, particularly mechanical pulps, tend to be prone to colour reversion, either due to the relatively high amounts of lignin and other impurities in these pulps or due to the residual peroxide which may be contained in these pulps.

Furthermore, although second stage bleaching with dithionite can be effective both to remove residual peroxide from the pulp and to effect further pulp bleaching, hydrosulfite compounds can be somewhat problematic as bleaching compounds because they may react to form sulfur containing by-products which are also believed to cause the pulp to be prone to colour reversion.

The use of a single reductive compound as both a means for eliminating residual peroxide and as a bleaching agent in second stage bleaching may also reduce the cost effectiveness of the overall bleaching process. In particular, the use of a relatively expensive reductive bleaching agent to eliminate residual peroxide from pulps is an inefficient use of the reducing agent, since an amount of reducing agent sufficient both to eliminate residual peroxide and to effect second stage bleaching must be used.

Although formamidine sulfinic acid is described in the above referenced prior art as a reducing agent which may be used for pulp bleaching, it is in practice typically used primarily for bleaching textile fibers or for removing printing dyes in the recovery of waste papers. It has not gained widespread acceptance as a reducing agent for pulp bleaching, due in part to its relatively high cost.

In addition, although formamidine sulfinic acid (thiourea dioxide) is described in the above referenced prior art as a reducing agent for pulp bleaching, the prior art contemplates that thiourea dioxide be employed in pulp bleaching in one of three very specific ways. First, thiourea dioxide may be employed in a single stage bleaching process, as exemplified by the Kindron, Turner and Cartsunis references. Second, thiourea dioxide may be. used in an intermediate reductive bleaching step between successive bleaching stages with peroxide, as exemplified by the Liebergott and Hoyos references. Third, thiourea may be combined with residual peroxide to form thiourea dioxide for use in a second bleaching stage following peroxide bleaching as exemplified by the Darlington and Kanada references.

There remains in the art of pulp bleaching a need for a relatively cost effective bleaching process which can be used in conjunction with bleaching with oxidizing agents such as peroxide compounds to produce a relatively bright bleached pulp which is not prone to colour reversion.

There is also a need for a bleaching process which can be used in conjunction with pulps bleached with oxidizing agents such as peroxide compounds to produce a bleached pulp which is suitable for use in the production of high quality paper products.

SUMMARY OF THE INVENTION

The present invention is a process for final bleaching cellulose-containing pulp which has been subjected to previous bleaching with an oxidizing agent. The process involves substantially eliminating residual oxidizing agent from the pulp before subjecting the pulp to a final bleaching with an amount of formamidine sulfinic acid.

The invention is based upon the discovery that the use of formamidine sulfinic acid as a bleaching agent in a final bleaching step after previous peroxide bleaching results in a pulp which exhibits demonstrably higher brightness than pulps which have been bleached only with peroxide compounds, which brightness is stable and not prone to colour reversion.

The term "final bleaching" as used in connection with the present invention means that the final bleaching step using formamidine sulfinic acid is the final bleaching process to which the pulp is subjected. In other words, the pulp is not bleached further with peroxide compounds, chlorine containing compounds or other reducing agents such as dithionite after the final bleaching step using formamidine sulfinic acid has been completed. It is the use of formamidine sulfinic acid as the final bleaching agent which is believed to result in the production using the invention of a bleached pulp having both high brightness and high brightness stability.

The process of the present invention may be used with any cellulose-containing pulp. The invention is particularly suited, however, to use in bleaching mechanical pulps (including both mechanical and chemi-mechanical pulps), since it tends to be more difficult to achieve high brightness and high brightness stability when bleaching mechanical pulps.

In one aspect, the invention is a process for final bleaching cellulose-containing pulp which has been subjected to previous bleaching with a peroxide compound, comprising the following steps in the sequence set forth:

(a) exposing the pulp to an amount of a reducing agent in order substantially to eliminate residual peroxide compound from the pulp; and (b) final bleaching the pulp by exposing the pulp to an amount of formamidine sulfinic acid.

Formamidine sulfinic acid is also known as thiourea dioxide and FAS, and may be referred to herein as FAS.

The peroxide compound used in the previous bleaching may be any organic or inorganic compound which contains one or more peroxy groups and which may be used as bleaching agent for cellulose-containing pulps. Among the most common peroxide compounds for bleaching pulps is hydrogen peroxide, but the invention is not limited only to use in conjunction. with pulps which have been subjected to previous bleaching with hydrogen peroxide as the peroxide compound.

The previous bleaching with a peroxide compound may be comprised of one or more discrete stages of bleaching with a peroxide compound. These discrete stages may or may not be separated by washing and/or neutralizing steps. The previous peroxide bleaching may take place under alkaline, neutral or acidic conditions. The previous bleaching with a peroxide compound may itself be preceded by bleaching with one or more other bleaching agents, including other oxidizing agents such as chlorine containing compounds or reducing agents such as dithionite.

In the preferred embodiment, the previous bleaching of the pulp has consisted of one or two discrete stages of bleaching with hydrogen peroxide. In the preferred embodiment, the previous bleaching has taken place under alkaline conditions. In the preferred embodiment, the pulp has been washed after completion of the previous bleaching but before the performance of the peroxide elimination step.

The previous peroxide bleaching and the process of the invention may be performed as one comprehensive bleaching process in a pulp or paper mill or may be performed separately. For example, the process of the invention may be performed in a paper mill on pulp which has been subjected to previous peroxide bleaching in a pulp mill and then transported to the paper mill.

The pH of the pulp should be regulated so that the pH of the pulp at the end of the final bleaching step is acidic or very slightly basic. Preferably the pH at the end of the final bleaching step is greater than about 5 and most preferably is between about 5 and about 8.5.

The minimum amount of FAS which is present for the final bleaching step may be any amount which is effective to increase the brightness of the pulp. The maximum amount of FAS is dictated by economic considerations. It has been found that the amount of FAS which is present for the final bleaching step should preferably be between about 0.1% and about 0.6% by weight of oven dried pulp in order to obtain satisfactory results at a reasonable cost.

The consistency of the pulp is a measure of the amount of pulp material that is present in the pulp slurry. The pulp consistency during the final bleaching step may vary widely. Preferably the lower limit of pulp consistency is about 3% and is dictated by economic considerations. The upper limit of pulp consistency depends upon the ability of mill equipment to process the pulp. Preferably the maximum pulp consistency during the final bleaching step is about 25%.

The temperature at which the final bleaching step takes place is preferably above about 25° Celsius and below about 100° Celsius. More preferably the temperature during the final bleaching step is between about 50° Celsius and about 100° Celsius.

The duration of the final bleaching step depends upon the parameters for optimization of the bleaching process. The final bleaching step should take place for a sufficient minimum time to cause increased brightness of the pulp, but should not take place for so long as to render the final bleaching step uneconomical. Preferably the final bleaching step takes place for at least about 5 minutes and preferably for less than about 120 minutes.

The objective of the peroxide elimination step is substantially to eliminate any residual peroxide compound from the pulp. The amount of reducing agent that is required to eliminate residual peroxide can be determined and controlled by measuring or monitoring the reduction potential of the pulp, by stoichiometric calculation, or by any other method.

The reducing agent that is used during the peroxide elimination step may be any compound or combination of compounds which will reduce the residual peroxide compound that is present in the pulp. As a result, many if not all reductive bleaching agents may be used as a reducing agent. in the peroxide elimination step. In addition, some compounds which are not suitable for use as reductive bleaching agents may be suitable for use as the reducing agent in the peroxide elimination step.

For example, the reducing agent may be selected from the group of reducing agents consisting of sulfur dioxide, sulfurous acid, salts of sulfurous acid, FAS, hydrosulfites, borohydrides, hydrazine, and mixtures thereof. The reducing agent may even be comprised of a compound such as ascorbic acid, which is very expensive but also quite effective as a reducing agent.

Preferably, however, the reducing agent is a relatively inexpensive compound and is also a compound that does not either contain or react to form undesirable by-products which may either reduce the brightness of the pulp or render the pulp more prone to colour reversion.

For this reason, hydrosulfites are not preferred reducing agents for use in the peroxide elimination step because they may react to form sulfur containing by-products which are believed to contribute to colour reversion of bleached pulps.

Similarly, FAS, borohydrides, hydrosulfites and hydrazines are not preferred reducing agents for use in the peroxide elimination step because they tend to be relatively expensive.

As a result, preferred reducing agents for use in the peroxide elimination step include sulfur dioxide and compounds which may be derived therefrom, including sulfurous acid and salts of sulfurous acid such as sulfites or bisulfites. These compounds are generally relatively inexpensive and are generally relatively effective in eliminating peroxide without the formation of undesirable by-products.

Among the representative salts of sulfurous acid which may be suitable for use in the peroxide elimination step are alkali metal sulfites, alkali earth metal sulfites, alkali metal bisulfites and alkali earth metal bisulfites. More specifically, suitable salts of sulfurous acid may include sodium sulfite and sodium bisulfite.

The presence of metal ions is detrimental to bleaching processes generally. As a result, the final bleaching step may be performed in the presence of an amount of a chelating agent so that the negative influence of metal ions can be reduced. The need or desirability of a chelating agent is dependent upon the types and amounts of metal ions that are present in the pulp slurry.

The chelating agent (when used) may be comprised of any one or more compounds which are effective to bond with and thus eliminate metal ions from the pulp slurry. One preferred chelating agent is diethylene triamine pentaacetic acid (DTPA). The amount of chelating agent required in order to obtain satisfactory results will vary depending upon the concentration of metal ions present in the pulp, but generally the amount of chelating agent (when used) preferably ranges from between about 0.05% and about 0.2% of chelating agent by weight of oven dried pulp.

DETAILED DESCRIPTION

The invention may be used with any cellulose-containing pulp, including mechanical, chemi-mechanical and chemical wood pulps. In the preferred embodiment, however, the invention is directed at the bleaching of mechanical and chemi-mechanical pulps (collectively referred to as "mechanical pulps") to produce bleached pulps which exhibit relatively high brightness and high brightness stability, which pulps may be used as substitutes for chemical pulps in such applications as papermaking.

Mechanical pulps are commonly bleached with peroxide compounds such as hydrogen peroxide under alkaline conditions in one or more stages in order to attain an acceptable pulp brightness. To achieve superior pulp brightness, such peroxide bleached pulps are sometimes subjected to further reductive bleaching with dithionite (sodium dithionite). Unfortunately, the increase in brightness provided by the dithionite bleaching tends not to be stable and the resultant pulp product tends therefore to be prone to colour reversion.

The process of the present invention produces a resultant pulp product which achieves a brightness level comparable with a peroxide bleached pulp which has been bleached with dithionite, but which also has greater brightness stability than peroxide/dithionite bleached pulp.

The invention is based upon the discovery that formamidine sulfinic acid (FAS) is a very effective reductive bleaching agent when used for final bleaching of peroxide bleached pulps. In particular, the use of FAS does not appear to result in the brightness stability problems (i.e., colour reversion), associated with dithionite bleached pulps.

The invention may be used in conjunction with any pulp which has already been subjected to previous bleaching with a peroxide compound such as hydrogen peroxide. The invention essentially involves final bleaching of peroxide bleached pulps with FAS. In the preferred embodiment, the process of the present invention comprises two essential steps.

The first step of the process of the invention consists of a peroxide elimination step in which pulp which has been subjected to previous peroxide bleaching is exposed to an amount of a reducing agent in order substantially to eliminate residual peroxide compound and other oxidizing agents from the pulp.

Peroxide bleaching of pulp leaves a portion of the peroxide compound unreacted. It has been theorized in the prior art that residual peroxide may contribute to colour reversion in bleached pulps. In addition, if residual peroxide compound is introduced into a subsequent bleaching step involving a reducing agent, the peroxide compound will increase the consumption of reducing agent as the peroxide compound will react with the reducing agent. Since reductive bleaching agents such as FAS tend to be relatively expensive, it is desirable to minimize the consumption of such compounds.

Any reducing agent which is effective to eliminate residual peroxide compound or other oxidizing agents from the pulp may be used in the peroxide elimination step. For example, the reducing agent used in the peroxide elimination step may be a reductive bleaching agent and may even be FAS.

Preferably, however, the reducing agent used in the peroxide elimination step is preferably an inexpensive reducing agent, and is therefore not necessarily a reductive bleaching agent.

In addition, the reducing agent which is used in the peroxide elimination step is preferably a reducing agent which does not contain or react to form by-products which are undesirable in the pulp. As a result, the reducing agent is preferably not a hydrosulfite compound, which can react to form sulfur containing by-products which are believed to affect negatively the brightness stability of bleached pulps.

In the preferred embodiment, the peroxide elimination step is therefore performed by exposing the pulp to one or more inexpensive reducing agents such as sulfur dioxide, sulfurous acid or salts of sulfurous acid such as sulfites and bisulfites, which eliminate any peroxide compound or other oxidizing reaction products which may be left in the pulp from the previous peroxide bleaching. Particular preferred reducing agents include sodium salts of sulfurous acid, more particularly sodium sulfite or sodium bisulfite.

In the preferred embodiment the peroxide elimination step is performed to a point where all of the oxidizing substances present are eliminated and a small excess of reducing agent is left in the pulp. The peroxide elimination step can be controlled by the measurement of reduction potential of the pulp, by stoichiometric calculation, or by any other means or technique.

In the preferred embodiment, the pulp may also be subjected to a washing step prior to the peroxide elimination step, thus potentially reducing the amount of reducing agent that is required for the peroxide elimination step and further reducing the cost of the overall process. In a paper mill, which purchases peroxide bleached mechanical pulp, some washing of the pulp will likely have been done in the pulp mill, so a separate washing step prior to the peroxide elimination step may be unnecessary.

The second step of the process of the invention consists of final bleaching the pulp by exposing the pulp to an amount of FAS.

After the peroxide elimination step is completed the brightness of the peroxide bleached pulp is further enhanced by reaction of the pulp with an aqueous solution of FAS in the final bleaching step. In the preferred embodiment, the final bleaching step is done under conditions of temperature, time and pulp consistency which are sufficient to utilize fully the bleaching potential of the FAS.

During the final bleaching step the pH of the pulp will drop as alkali is consumed by the FAS. It is important to the process of the present invention that the correct amount of alkali be present to obtain the best bleaching effect from the FAS. Too low as well as too high a pH may decrease the bleaching effect of the FAS. The alkali required may be provided entirely by the alkali present in the reducing agent used in the peroxide elimination step but extra alkali, normally supplied as sodium hydroxide, may need to be added to the pulp during the final bleaching step to adjust the pH of the slurry.

Metal ions present in the pulp can negatively affect the effectiveness of the final bleaching step. Depending upon the types and concentration of metal ions present in the pulp, it may be necessary to perform the final bleaching step in the presence of an amount of a chelating agent. In circumstances where a chelating agent is necessary or desirable, a preferred chelating agent is diethylene triamine pentaacetic acid (DTPA).

In a preferred embodiment of the invention the final bleaching step is performed under the following conditions:

1. The amount of FAS used in the final bleaching step is preferably between about 0.1% and about 0.6% by weight of oven dried pulp (i.e., from about 1 kilogram to about 6 kilograms of FAS per metric ton). Amounts of FAS below about 0.1% by weight of oven dried pulp (i.e., about 1 kilogram per metric ton) my result in a bleaching effect which is too small to justify the expense of the equipment necessary for the final bleaching step. Amounts of FAS higher than about 0.6% may not result in significantly improved results. Most preferably the amount of FAS used in the final bleaching step is between about 0.15% and about 0.4% by weight of oven dried pulp (i.e., about 1.5 kilograms to about 4 kilograms per metric ton).

2. The pH during the final bleaching step is preferably maintained so that the pH of the pulp at the end of the final bleaching step is acidic, neutral, or slightly basic. Most preferably the pH at the end of the final bleaching step is between about 5 and 8.5.

3. The consistency of the pulp during the final bleaching step is preferably at least about 3% weight of oven dried pulp. More preferably the consistency of the pulp during the final bleaching step is between about 3% and about 25%. Most preferably the consistency of the pulp during the final bleaching step is between about 6% and about 20%.

4. The final bleaching step preferably takes place at a temperature of at least about 25° Celsius. More preferably the final bleaching step takes place at a temperature of at least about 50° Celsius. Most preferably the final bleaching step takes place at a temperature of between about 50° Celsius and about 100° Celsius.

5. The final bleaching step preferably takes place for at least about 5 minutes in order to provide sufficient time for the FAS to effect the final bleaching of the pulp. More preferably the final bleaching step takes place for between about 5 minutes and about 120 minutes. Most preferably the final bleaching step takes place for between about 10 minutes and about 90 minutes.

6. Where a chelating agent is necessary or desirable, the final bleaching step preferably takes place in the presence of an amount of chelating agent between about 0.05% and about 0.2% by weight of oven dried pulp. Preferably the chelating agent is comprised of diethylene triamine pentaacetic acid (DTPA).

The influence of the different parameters and the effect of the process is described in the following examples.

EXAMPLE 1

Influence of Peroxide Elimination Step

The effect of residual peroxide on pulp brightness is demonstrated in Table 1 below. A peroxide bleached chemi-mechanical pulp from North American aspen was collected after a peroxide bleaching stage. The pulp was washed to contain two different amounts of peroxide. One washed sample was also subjected to a peroxide elimination step with sodium sulfite as the reducing agent to remove all traces of residual peroxide. The three pulps were then final bleached with different amounts of FAS. The conditions during the final bleaching step were as follows:

(a) amount of FAS present during final bleaching step—varied (b) pH at end of final bleaching step—6.5 to 7.5

(c) pulp consistency during final bleaching step—7%

(d) temperature during final bleaching step—80° Celsius (e) duration of final bleaching step—60 minutes

TABLE 1

| | Sample 1-F Unwashed | Sample 2 Washed | Sample 3 Washed and Subjected to Peroxide Elimination Step |
|---|---|---|---|
| Residual peroxide (% by dry weight of pulp) | 1.0 | 0.15 | −0.4 (sulfite excess) |
| Amount of FAS used in Final Bleaching Step (% by dry weight of pulp) | Brightness ISO % | Brightness ISO % | Brightness ISO % |
| No Final Bleaching Step | 85.0 | 85.0 | 85.0 |
| 0.1 | 84.4 | 84.4 | 85.1 |
| 0.2 | 84.4 | 84.5 | 86.5 |
| 0.3 | 84.5 | 85.3 | 87.0 |
| 0.4 | 85.0 | 85.6 | 87.1 |
| 0.6 | 85.5 | 86.7 | 87.3 |

EXAMPLE 2

Influence of Amount of FAS

The effect on pulp brightness of varying the amount of FAS present during the final bleaching step is demonstrated in Table 2 below. Two peroxide bleached chemi-mechanical pulps (from North American aspen) were final bleached with different amounts of FAS. The two pulp samples had been washed and subjected to a peroxide elimination step with sodium sulfite as a reducing agent before the final bleaching with FAS. The conditions during the final bleaching step were as follows:

(a) amount of FAS present during final bleaching step—varied (b) pH at end of final bleaching step—5.5 to 6.5

(c) pulp consistency during final bleaching step—7%

(d) temperature during final bleaching step—80° Celsius (e) duration of final bleaching step—60 minutes

TABLE 2

| Amount of FAS used in Final Bleaching Step (% by dry weight of pulp) | Sample 1 Brightness ISO % | Sample 2 Brightness ISO % |
|---|---|---|
| No Final Bleaching Step | 80.6 | 85.0 |
| 0.1 | 81.4 | 85.1 |
| 0.2 | 83.1 | 86.5 |

TABLE 2-continued

| Amount of FAS used in Final Bleaching Step (% by dry weight of pulp) | Sample 1 Brightness ISO % | Sample 2 Brightness ISO % |
|---|---|---|
| 0.3 | 84.1 | 87.0 |
| 0.4 | 84.6 | 87.1 |
| 0.6 | 85.1 | 87.3 |

EXAMPLE 3

Influence of pH Upon the Final Bleaching Step

The influence of pH during the final bleaching step is demonstrated in Table 3 below. Three peroxide bleached chemi-mechanical pulps from aspen were subjected to a final bleaching step with FAS under different alkali additions. The pH upon termination of the final bleaching step was recorded. The three pulp samples had been washed and subjected to a peroxide elimination step with sodium sulfite as a reducing agent before the final bleaching step with FAS. The conditions during the final bleaching step were as follows:

(a) amount of FAS present during final bleaching step—varied (b) pH at end of final bleaching step—varied (c) pulp consistency during final bleaching step—7%

(d) temperature during final bleaching step varied (e) duration of final bleaching step—60 minutes

TABLE 3

| | Sample 1 | Sample 2 | Sample 3 |
|---|---|---|---|
| Temperature during Final Bleaching Step (° Celsius) | 80 | 65 | 80 |
| | Brightness ISO % | Brightness ISO % | Brightness ISO % |
| No Final Bleaching Step | 80.6 | 85.0 | 84.6 |
| Amount of FAS used in Final Bleaching Step (% by dry weight of pulp) | 0.3 | 0.3 | 0.5 |
| pH at end of Final Bleaching Step: | | | |
| 5.0 | — | — | 85.4 |
| 5.3 | — | — | 85.9 |
| 5.5 | 83.3 | — | — |
| 5.9 | — | 86.6 | 85.9 |
| 6.1 | 83.7 | 86.7 | |
| 6.3 | — | — | 86.5 |
| 7.0 | 84.1 | 86.8 | — |
| 7.3 | 84.0 | 86.6 | 86.0 |
| 7.5 | 84.0 | — | — |
| 8.5 | — | 86.4 | — |

EXAMPLE 4

Influence of Duration of Final Bleaching Step

The influence of duration of the final bleaching step is demonstrated in Table 4 below. Two peroxide bleached chemi-mechanical pulps from North American aspen were subjected to FAS final bleaching steps of varying duration. The two pulp samples had been washed and subjected to a peroxide elimination step with sodium sulfite as a reducing agent before the final bleaching step. The conditions during the final bleaching step were as follows:

(a) amount of FAS present during final bleaching step—0.3%

(b) pH at end of final bleaching step—6.9 to 7.4

(c) pulp consistency during final bleaching step—7%

(d) temperature during final bleaching step—varied (e) duration of final bleaching step—varied

TABLE 4

| | Sample 1 | Sample 2 |
|---|---|---|
| Temperature during Final Bleaching Step (° Celsius) | 80 | 60 |
| | Brightness ISO % | Brightness ISO % |
| No Final Bleaching Step | 85.0 | 85.0 |
| Duration of Final Bleaching Step (minutes) | | |
| 5 | 86.7 | 86.0 |
| 15 | 86.8 | 86.3 |
| 30 | 86.9 | 86.3 |
| 60 | 87.0 | 86.7 |
| 90 | — | 86.5 |
| 120 | 87.3 | 86.7 |

EXAMPLE 5

Influence of Pulp Consistency Upon Final Bleaching Step

The effect of consistency during the FAS treatment is demonstrated in Table 5 below. Two peroxide bleached chemi mechanical pulps from North American aspen were subject to a final bleaching step with FAS. The two pulp samples had been washed and subject to a peroxide elimination step with sodium sulfite as a reducing agent before the final bleaching step. The conditions during the final bleaching step were as follow:

(a) amount of FAS present during final bleaching step—0.3%

(b) pH at end of final bleaching step—6.8 to 7.3

(c) pulp consistency during final bleaching step—varied (d) temperature during final bleaching step—varied (e) duration of final bleaching step—60 minutes

TABLE 5

| | Sample 1 | Sample 2 |
|---|---|---|
| Temperature during Final Bleaching Step (° Celsius) | 80 | 65 |
| | Brightness ISO % | Brightness ISO % |
| No Final Bleaching Step | 80.6 | 85.0 |
| Pulp Consistency during Final Bleaching Step (%) | | |
| 3 | 83.9 | 86.2 |
| 5 | 84.2 | 86.3 |
| 7 | 84.3 | 86.6 |
| 9 | — | 86.7 |
| 10 | — | 86.8 |

EXAMPLE 6

Influence of Temperature Upon Final Bleaching Step

The importance of temperature during the final bleaching step is demonstrated in Table 6 below. A peroxide bleached chemi-mechanical pulp from North American aspen was subjected to a final bleaching step with FAS taking place at different temperatures. The pulp sample had been washed and subjected to a peroxide elimination step with sodium sulfite as a reducing agent before the final bleaching step. The conditions during the final bleaching step were as follows:

(a) amount of FAS present during final bleaching step—0.3%
(b) pH at end of final bleaching step—6.8 to 7.3
(c) pulp consistency during final bleaching step—7%
(d) temperature during final bleaching step—varied
(e) duration of final bleaching step—60 minutes

TABLE 6

| Temperature during Final Bleaching Step | | Brightness |
|---|---|---|
| ° Celsius | ° Fahrenheit | ISO % |
| No Final Bleaching Step | | 85.0 |
| 26 | 79 | 85.2 |
| 50 | 122 | 86.2 |
| 60 | 140 | 86.6 |
| 65 | 149 | 86.8 |
| 80 | 176 | 87.2 |
| 95 | 203 | 87.2 |

EXAMPLE 7

Influence of Chelating Agent Upon Final Bleaching Step

The effect of performing the final bleaching step in the presence of a chelating agent is demonstrated in Table 7 below. Two peroxide bleached chemi-mechanical pulps from North American aspen were subjected to a final bleaching step with FAS in the presence of 0%, 0.1% and 0.2% diethylene triamine pentaacetic acid (DTPA). From Table 7 it can be seen that the presence of small amounts of a chelating agent during the final bleaching step may improve the brightness gain by as much as 0.3% to 0.4% ISO. The conditions during the final bleaching step were as follows:

(a) amount of FAS present during final bleaching step—0.3%
(b) pH at end of final bleaching step—6.8 to 7.3
(c) pulp consistency during final bleaching step—7%
(d) temperature during final bleaching step—80° Celsius
(e) duration of final bleaching step—60 minutes

TABLE 7

| Amount of FAS Used in Final Bleaching Step (% by dry weight of pulp) | Amount of DTPA used in Final Bleaching Step (% by dry weight of pulp) | Sample 1 Brightness ISO % | Sample 2 Brightness ISO % |
|---|---|---|---|
| No Final Bleaching Step | | 85.0 | 80.6 |
| 0.3 | 0.0 | 87.0 | 84.2 |
| 0.3 | 0.1 | 87.4 | 84.6 |
| 0.3 | 0.2 | 87.3 | 84.5 |

EXAMPLE 8

Influence of Final Bleaching Step Upon Brightness Stability

Table 8 below provides a comparison between the brightness stability of pulps subjected to a final bleaching step with FAS and pulps bleached conventionally with dithionite (also known as "Hydro" or "hydrosulfiite") in a final bleaching step after peroxide bleaching. The tests were carried out in full scale mill operation and the storage was done under normal conditions in the mill's warehouse. From Table 8 it can be seen that final bleaching with dithionite after peroxide bleaching gives a brightness increase that quickly reverts. For pulps subjected to a final bleaching step with FAS, the brightness increase was found to be more or less stable during subsequent storage of the pulp. Note that the final bleaching step with FAS could not be performed under optimal temperature and time conditions due to the process layout of the mill. The conditions during the final bleaching step using FAS and dithionite were as follows:

(a) amount of FAS or dithionite present during final bleaching step—0.3%
(b) pH at end of final bleaching step—5 to 8
(c) pulp consistency during final bleaching step—6%
(d) temperature during final bleaching step—55° Celsius
(e) duration of final bleaching step—15 minutes (average)

TABLE 8

| | Sample 1 | Sample 2 | Sample 3 | Sample 4 | Sample 5 |
|---|---|---|---|---|---|
| | Final Bleaching Step using Dithionite | Final Bleaching Step using Dithionite | Final Bleaching Step using FAS | Final Bleaching Step using FAS | Final Bleaching Step using FAS |
| Amount of Bleaching Agent (% by dry weight of pulp) | 1.0 | 0.7 | 0.3 | 0.3 | 0.25 |
| | Brightness ISO % | Brightness ISO % | Brightness ISO % | Brightness ISO % | Brightness ISO % |
| Before Final Bleaching Step | 84.1 | 84.5 | 84.7 | 84.5 | 79.8 |
| After Final Bleaching Step | 85.4 | 85.5 | 86.4 | 85.8 | 81.5 |
| Duration of Pulp Storage | | | | | |
| 9 days | 84.4 | 85.3 | 86.3 | — | 81.4 |
| 19 days | 84.4 | — | 86.3 | — | — |
| 25 days | — | 84.8 | 86.3 | — | — |
| 29 days | 84.1 | — | — | — | — |
| 37 days | — | 84.5 | — | 85.7 | — |
| 50 days | — | — | 86.0 | 85.9 | 81.1 |
| 105 days | — | 84.4 | — | 85.5 | 81.1 |
| 199 days | — | — | 85.9 | 85.7 | — |

From the foregoing examples it may be seen that the process of the present invention results in a bleached mechanical pulp which exhibits both high brightness and high brightness stability.

Some mechanical pulps (i.e., mechanical and chemi-mechanical pulps) have in recent years become desired for papermaking due to their high yield properties. One example of such a pulp is BCTMP (bleached chemi-thermo-mechanical pulp). High yield pulps are of benefit in papermaking because a lower density pulp stock can be used if the bulk value of the pulp is increased (the bulk value of a pulp is inversely related to the density of the pulp). In other words, the use of high yield pulps in papermaking may result in less pulp (by weight) being required to create the same "volume" of paper (i.e., same area and caliper thickness) in comparison with papers made with low yield pulps.

The move towards higher bulk mechanical pulps for papermaking is made more complicated by difficulties associated with achieving high and stable brightness when bleaching such pulps. A further complication is that many bleaching processes are harmful to pulp fibers, with the result that bleaching the pulp may actually reduce the bulk value of the pulp.

In particular, peroxide bleaching is often performed under alkaline conditions in which sodium hydroxide is added to the pulp along with the peroxide compound. The effectiveness of an alkaline peroxide bleaching process in producing a pulp with high brightness is dependent upon the pH at which the peroxide bleaching process takes place, with the brightness of the pulp increasing as the pH (alkaline content) increases. Unfortunately alkali attacks the walls of pulp fibers, causing them to soften and collapse, thus reducing the bulk value of the bleached pulp. There is therefore a tension inherent in papermaking using high yield pulps between preserving the bulk value of the pulp and achieving a high pulp brightness.

As the above examples demonstrate, the performance of a final bleaching step using FAS following previous bleaching with a peroxide compound can increase significantly the brightness of the pulp beyond that which is possible using only peroxide bleaching, thus eliminating the need to rely solely on high alkali peroxide bleaching techniques which are harmful to pulp fibers. The examples also demonstrate that the increase in brightness achieved by a final bleaching with FAS is more stable than brightness gains achieved through dithionite bleaching.

The present invention therefore is of considerable significance to the papermaking industry, which requires pulp stock which is both bright and stable. The invention also provides pulp manufacturers with the choice either of producing an increased bulk pulp at a standard brightness level or producing an increased brightness pulp at a standard bulk value.

These options may be illustrated with reference to one "current" technology for bleaching mechanical pulps which involves initial dithionite bleaching followed by one or two stages of peroxide bleaching. This current technology has been demonstrated to produce reasonable levels of brightness at reasonable cost.

As a first example, the process of the present invention could be applied to a pulp which has been previously bleached using the current technology described above. The first example therefore utilizes dithionite, peroxide and FAS as bleaching agents. Preliminary testing has suggested that this first example could conceivably be used to increase the brightness of a resulting pulp product without reducing its bulk value, but at increased cost due to the addition of FAS as a bleaching agent.

As a second example, the process of the present invention could be applied to a pulp which has been previously bleached only with peroxide, therefore eliminating dithionite as a bleaching agent and potentially reducing the amount of peroxide that is required. Preliminary testing has suggested that the process of this second example may result in the production of a bleached pulp having a brightness and bulk value comparable to that which can be produced by using the current technology, but at potentially reduced cost due to the effectiveness of FAS as a bleaching agent.

The process of the present invention may therefore be used to enhance further the brightness of pulps which have been previously bleached with conventional peroxide bleaching techniques, including dithionite/peroxide bleaching techniques. Alternatively, the process of the present invention may conceivably be used to reduce the cost of bleaching pulps to a given brightness and bulk value in comparison with conventional peroxide bleaching techniques. Finally, the process of the present invention, using FAS as a bleaching agent, does not appear to affect significantly the bulk value of the bleached pulp, making the process an ideal candidate for use in bleaching high yield mechanical pulps for use in papermaking.

The embodiments of the invention in which an exclusive property or privilege is claimed are defined as follows:

1. A process for final bleaching cellulose-containing pulp which has been subjected to previous bleaching with a peroxide compound, comprising the following steps in the sequence set forth:

(a) exposing the pulp to an amount of a reducing agent in order substantially to eliminate residual peroxide compound from the pulp; and (b) final bleaching the pulp by exposing the pulp to an amount of formamidine sulfinic acid.

2. The process as claimed in claim 1 wherein the amount of formamidine sulfinic acid present for the final bleaching step is greater than about 0.1% by weight of oven dried pulp, wherein the pH of the pulp upon termination of the final bleaching step is greater than about 5, wherein the consistency of the pulp during the final bleaching step is at least about 3%, wherein the final bleaching step takes place at a temperature of at least about 25° Celsius, and wherein the final bleaching step takes place for at least about 5 minutes.

3. The process as claimed in claim 2 wherein the amount of formamidine sulfinic acid present for the final bleaching step is between about 0.1% and about 0.6% by weight of oven dried pulp.

4. The process as claimed in claim 2 wherein the pH of the pulp upon termination of the final bleaching step is between about 5 and about 8.5.

5. The process as claimed in claim 2 wherein the consistency of the pulp during the final bleaching step is between about 3% and about 25%.

6. The process as claimed in claim 2 wherein the final bleaching step takes place at a temperature between about 25° Celsius and about 100° Celsius.

7. The process as claimed in claim 2 wherein the final bleaching step takes place for between about 5 minutes and about 120 minutes.

8. The process as claimed in claim 2 wherein the reducing agent for the peroxide elimination step is selected from the group of reducing agents consisting of sulfur dioxide, sulfurous acid, salts of sulfurous acid, formamidine sulfinic acid, hydrosulfites, borohydrides, hydrazine, and mixtures thereof.

9. The process as claimed in claim 8 wherein the reducing agent for the peroxide elimination step is selected from the group of reducing agents consisting of formamidine sulfinic acid, hydrosulfites, borohydrides, hydrazine, and mixtures thereof.

10. The process as claimed in claim 8 wherein the reducing agent for the peroxide elimination step is selected from the group of reducing agents consisting of sulfur dioxide, sulfurous acid, salts of sulfurous acid, and mixtures thereof.

11. The process as claimed in claim 10 wherein the amount of formamidine sulfinic acid present for the final bleaching step is between about 0.1% and about 0.6% by weight of oven dried pulp, wherein the pH of the pulp upon termination of the final bleaching step is between about 5 and about 8.5, wherein the consistency of the pulp during the final bleaching step is between about 3% and about 25%, wherein the final bleaching step takes place at a temperature of between about 25° Celsius and about 100° Celsius, and wherein the final bleaching step takes place for between about 5 minutes and about 120 minutes.

12. The process as claimed in claim 11 wherein the reducing agent for the peroxide elimination step is selected from the group of reducing agents consisting of sulfur dioxide, sulfurous acid, alkali metal sulfites, alkali earth metal sulfites, alkali metal bisulfites, alkali earth metal bisulfites and mixtures thereof.

13. The process as claimed in claim 12 wherein the reducing agent for the peroxide elimination step is selected from the group consisting of sulfur dioxide, sulfurous acid, sodium sulfite, sodium bisulfite, and mixtures thereof.

14. The process as claimed in claim 11 wherein the final bleaching step takes place in the presence of an amount of a chelating agent.

15. The process as claimed in claim 14 wherein the chelating agent is comprised of diethylene triamine pentaacetic acid.

16. The process as claimed in claim 15 wherein the amount of chelating agent is between about 0.05% and about 0.2% by weight of oven dried pulp.

17. The process as claimed in claim 11, further comprising the step of washing the pulp to wash residual peroxide compound from the pulp prior to performing the peroxide elimination step.

18. The process as claimed in claim 11 wherein the pulp is either a mechanical wood pulp, a chemi-mechanical wood pulp, or a mixture thereof.

* * * * *